US007207128B2

(12) United States Patent
Cook

(10) Patent No.: US 7,207,128 B2
(45) Date of Patent: Apr. 24, 2007

(54) DISPLAY APPARATUS

(76) Inventor: Sam Cook, 8 Kensington Park Mews, London W11 2EY (GB)

( * ) Notice: Subject to any disclaimer, the term of this patent is extended or adjusted under 35 U.S.C. 154(b) by 312 days.

(21) Appl. No.: 10/497,104

(22) PCT Filed: Nov. 29, 2002

(86) PCT No.: PCT/GB02/05392

§ 371 (c)(1),
(2), (4) Date: Dec. 20, 2004

(87) PCT Pub. No.: WO03/049069

PCT Pub. Date: Jun. 12, 2003

(65) Prior Publication Data

US 2005/0102880 A1 May 19, 2005

(30) Foreign Application Priority Data

Nov. 29, 2001 (GB) ..... 0128639.2

(51) Int. Cl.
*G09F 17/00* (2006.01)

(52) U.S. Cl. ..... 40/603; 160/328; 160/378; 38/102.91

(58) Field of Classification Search ..... 40/795, 40/792, 603, 604; 160/328, 378; 38/102.91
See application file for complete search history.

(56) References Cited

U.S. PATENT DOCUMENTS 3,833,046 A 9/1974 Tombu
4,265,039 A * 5/1981 Brooks ..... 40/603
4,403,642 A * 9/1983 Morris ..... 160/380
4,430,815 A * 2/1984 Wulc ..... 38/102.91
5,046,545 A 9/1991 Loomis et al.
5,239,765 A 8/1993 Opdahl
5,301,447 A * 4/1994 Lotter et al. ..... 40/603
5,893,227 A * 4/1999 Johansson et al. ..... 40/603
6,164,364 A 12/2000 Morris
6,862,825 B1 * 3/2005 Lowndes ..... 40/603
2002/0029504 A1 * 3/2002 Lowndes ..... 40/603
2004/0237365 A1 * 12/2004 Johansson et al. ..... 40/603

FOREIGN PATENT DOCUMENTS

DE 43 41 741 A1 6/1995

(Continued)

*Primary Examiner*—Gary C. Hoge
(74) *Attorney, Agent, or Firm*—Gottlieb, Rackman & Reisman

(57) ABSTRACT

A pair of elongate holding devices (7*a*, 7*c*) extending along opposite sides of an imaginary rectangle have respective longitudinal recesses (12, 21) which hold respective edge portions (6*a*, 6*c*) of a poster (6). One holding device (7*c*) has a fixed bearing member (16) and a movable member (18) which contains the recess (21) and which is pivotable about a pivot axis (19) from an active position, in which the recess (21) is open in a direction away from the opposite holding device so that the poster (6) tums back on itself near the edge portion (6*c*), the poster being under tension between the pair of holding devices, to a passive position, in which tension in the poster is released sufficiently to allow the edge portion (6*c*) to be removed from the recess (21). The holding device (7*a*) is preferably an upper holding device with an undercut slot (12) slidably receiving a bead (14) at the upper edge portion (6*a*) of the poster. The movable member (18) has wings cooperating with cylindrical bearing surfaces on the fixed bearing member (16) to ensure that no excessive local stress is applied to the holding device (7*c*).

9 Claims, 3 Drawing Sheets

FOREIGN PATENT DOCUMENTS

| | | |
|---|---|---|
| EP | 0 495 688 A1 | 7/1992 |
| FR | 2 693 822 | 1/1994 |
| GB | 2 302 436 A | 1/1997 |
| WO | WO 00/05705 | 2/2000 |
| WO | WO 01/35382 A1 | 5/2001 |

* cited by examiner

DISPLAY APPARATUS

This invention relates to apparatus for displaying a poster. In this specification the word "poster" is used as a general term and includes any form of sheet material bearing an image, artwork, or lettering, e.g. an advertising banner.

It is known to mount a poster in display apparatus comprising a frame fixed to a support such as a wall, a light box, or the side of a vehicle.

What is desired is display apparatus which facilitates mounting and removal of a poster.

In one aspect the invention provides display apparatus comprising at least one pair of elongate holding devices extending along opposite sides of an imaginary rectangle, the holding devices having respective longitudinal recesses which hold respective edge portions of a poster, at least one holding device of the pair comprising a fixed bearing member and a movable member which contains the recess and which is pivotable about a pivot axis relative to the fixed bearing member from an active position, in which the recess is open in a direction away from the opposite holding device so that the poster turns back on itself near the edge portion, the poster being under tension between the pair of holding devices, to a passive position, in which tension in the poster is released sufficiently to allow the edge portion to be removed from the recess of the said one holding device.

In another aspect the invention provides display apparatus comprising at least one pair of elongate holding devices extending along opposite sides of an imaginary rectangle, the holding devices having respective longitudinal recesses for holding respective edge portions of a poster, at least one holding device of the pair comprising a fixed bearing member and a movable member which contains the recess and which is pivotable about a pivot axis relative to the fixed bearing member from a passive position, in which the edge portion of a poster can be inserted into the recess while the poster is held by the opposite holding device, to an active position, in which the recess is open in a direction away from the opposite holding device so that the poster turns back on itself near the edge portion, motion from the passive position to the active position applying tension to the poster.

In another aspect the invention provides display apparatus in which the fixed bearing member has a fixed end portion, an intermediate portion, and a free end portion, the intermediate portion has a convex bearing surface, part of which is cylindrical, the free end portion has a cylindrical external bearing surface coaxial with the cylindrical part of the convex bearing surface of the intermediate portion but of smaller diameter, the movable member has first and second longitudinal wings which define between them an open cavity to receive the free end portion and intermediate portion of the fixed bearing member, the first wing has in the cavity a concave cylindrical bearing surface which matches the cylindrical external bearing surface of the free end portion, and the first wing is received in a space between the free end portion and the intermediate portion of the fixed bearing member when the movable member is in its passive position.

In another aspect the invention provides display apparatus in which the movable bearing member is connected to the fixed bearing member so that the movable member cannot be removed from the fixed bearing member in any direction transverse to the pivot axis.

The invention will be described further, by way of example only, with reference to the accompanying drawings, in which.

Figure 1:
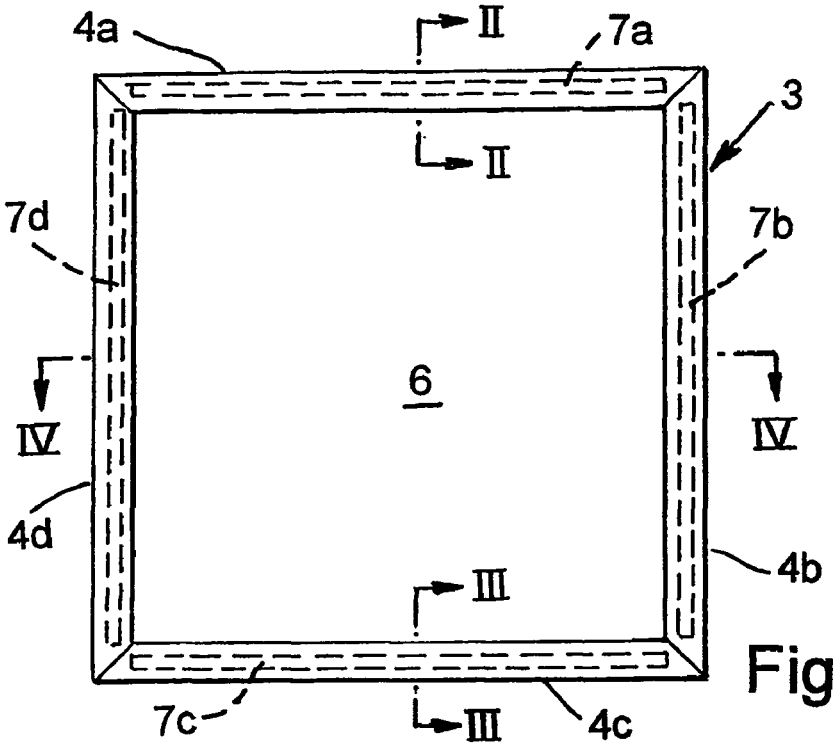
FIG. 1 is a front elevation of one embodiment of the display apparatus.

The display apparatus illustrated comprises a light box 1 constructed of aluminium sections defining a rectangular rim 2 to which a covering frame 3 is fitted. The frame 3 is made up of four extruded aluminium sections 4*a–d* and can be removed from the light box to allow mounting and removal of a poster 6. In an alternative embodiment, the upper frame section 4*a*, or any of the other frame sections, may be pivoted to the light box 1, to allow the frame 3 to be tilted away from the poster.

The display apparatus includes four elongate holding devices 7*a–d* for holding respective edge portions 6*a–d* of the poster 6. The holding devices are fixed to mounting plates 8 which are, in turn, fixed to the rim 2 of the light box 1 by bolts 9. The poster 6 is made of reinforced PVC (or any other suitable more or less resilient sheet material) and is under tension between the upper and lower holding devices 7*a*,7*c* and between the lateral holding devices 7*b*,7*d*.

Figure 2:
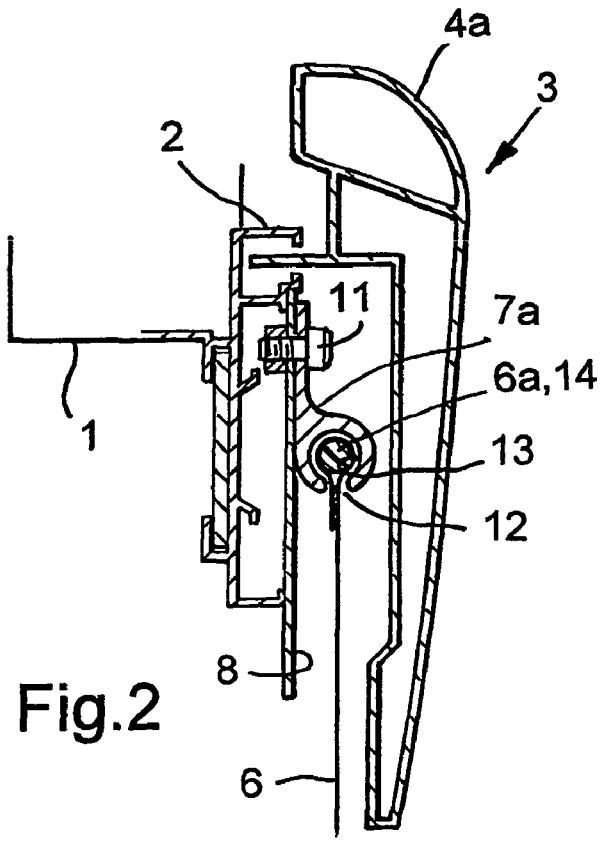
FIG. 2 is an enlarged section taken on line II—II in FIG. 1.
Figure 3:
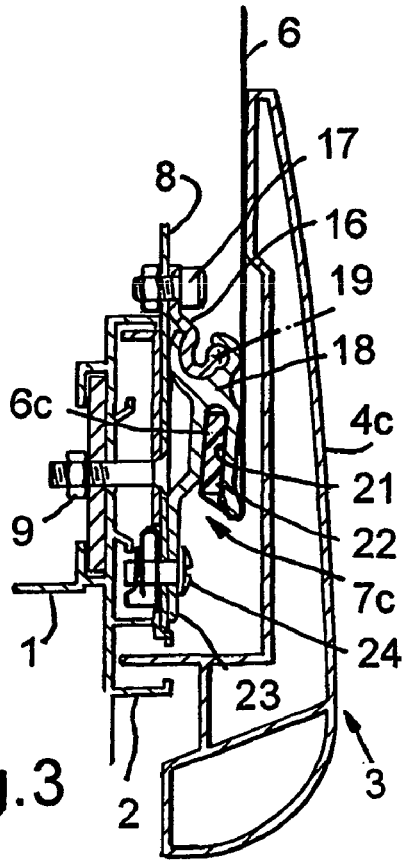
FIG. 3 is an enlarged section taken on line III—III in FIG. 1.
Figure 4:
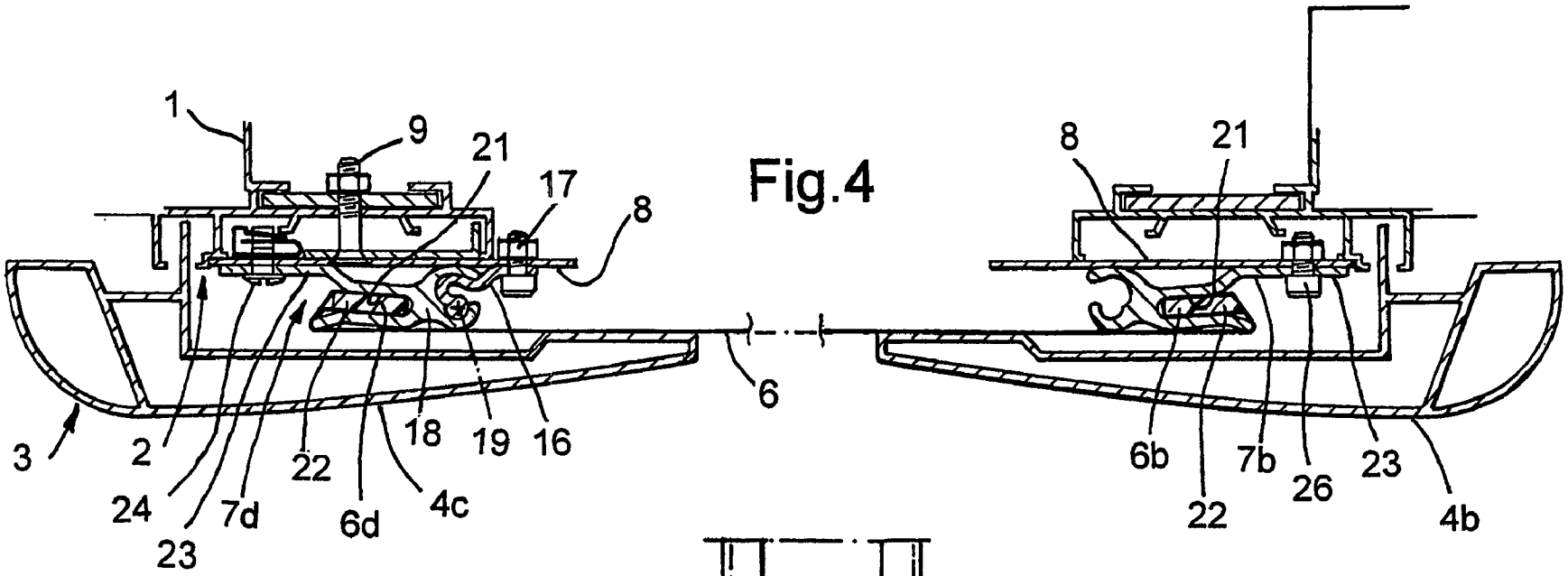
FIG. 4 is an enlarged section taken on line IV—IV in FIG. 1.
Figure 5:
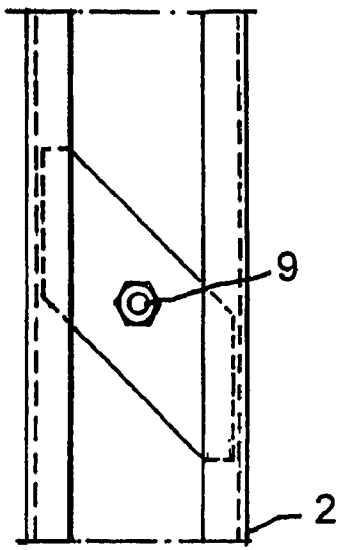
FIG. 5 is a view taken in the direction of arrow V in FIG. 4.

The upper holding device 7*a* comprises a single aluminium section which extends horizontally and which is fixed to the corresponding mounting plate 8 by a series of bolts 11 (only one of which is visible in FIG. 2). In the underside of the holding device 7*a* there is an undercut slot 12 communicating with a generally cylindrical internal cavity 13 and accommodating a longitudinal bead 14 constituting the upper edge portion 6*a* of the poster. The bead 14 is constructed by turning the edge of the sheet material of the poster 6 around a plastics rod (which may be solid, as shown, or hollow) and welding (or otherwise fixing) the sheet material to itself. The upper edge portion 6*a* of the poster is a loose fit in the holding device 7*a*, so that it can be slid along the holding device when the poster 6 is not under vertical tension.

The lower holding device 7*c* and the left-hand lateral holding device 7*d* are similar to each other. Each comprises a fixed bearing member 16 in the form of an extruded aluminium section fixed to the corresponding mounting plate 8 by bolts 17, and a movable member 18 which is also constituted by an aluminium section. The movable member 18 is pivotable about a pivot axis 19 relative to the fixed member 16. The movable member 18 has a longitudinal recess 21 which is open in a direction away from the opposite holding device and which receives the enlarged edge portion 6*c* or 6*d* of the poster 6. The enlarged edge portion is formed by passing the sheet material of the poster around a plastics strip 22 of generally rectangular cross-section and welding (or otherwise fixing) the sheet material to itself. An extension 23 of the movable member 18 is releasably connected to the mounting plate 8 by screws 24.

The right-hand lateral holding device 7*b* is constituted by an extruded aluminium section which is identical to the movable member 18 but which has its extension 23 fixed to the corresponding mounting plate 8 by a series of bolts 26.

To mount the poster 6 in the display apparatus, the bead 14 along the upper edge of the poster is fitted into the left-hand end of the undercut slot in the fixed upper holding device 7*a* and is slid along the undercut slot. The enlarged right-hand edge portion 6*b* of the poster 6 is then inserted in the recess 21 in the fixed holding device 7*b*. At this time, the movable member 18 of each of the lower and left hand holding devices 7*c*,7*d* is in the passive position shown in FIG. 6B, in which the recess 21 is open towards the front. The remaining edge portions 6*c* and 6*d* of the poster are inserted into the respective recesses 21 of the respective holding devices 7*c* and 7*d*. Motion of each movable member 18 from the passive position shown in FIG. 6B to the active position shown in FIG. 6A applies tension to the poster 6. Finally, the extensions 23 are screwed to the mounting plates 8 and the covering frame 3 is fitted on the light box 1.

Figure 6A:
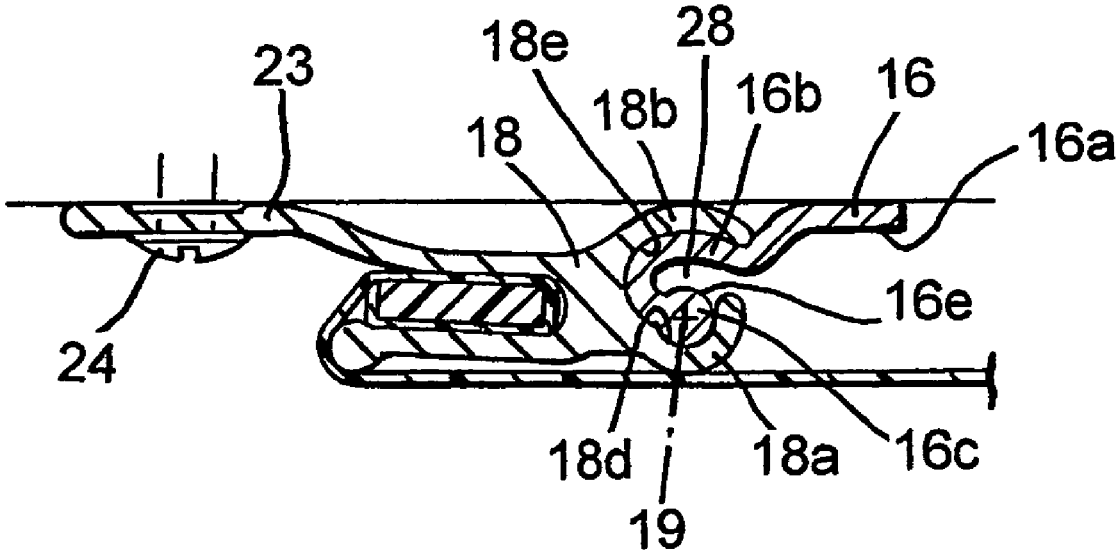
FIG. 6A is an enlarged section through a holding device in which a movable member is in an active position.
Figure 6B:
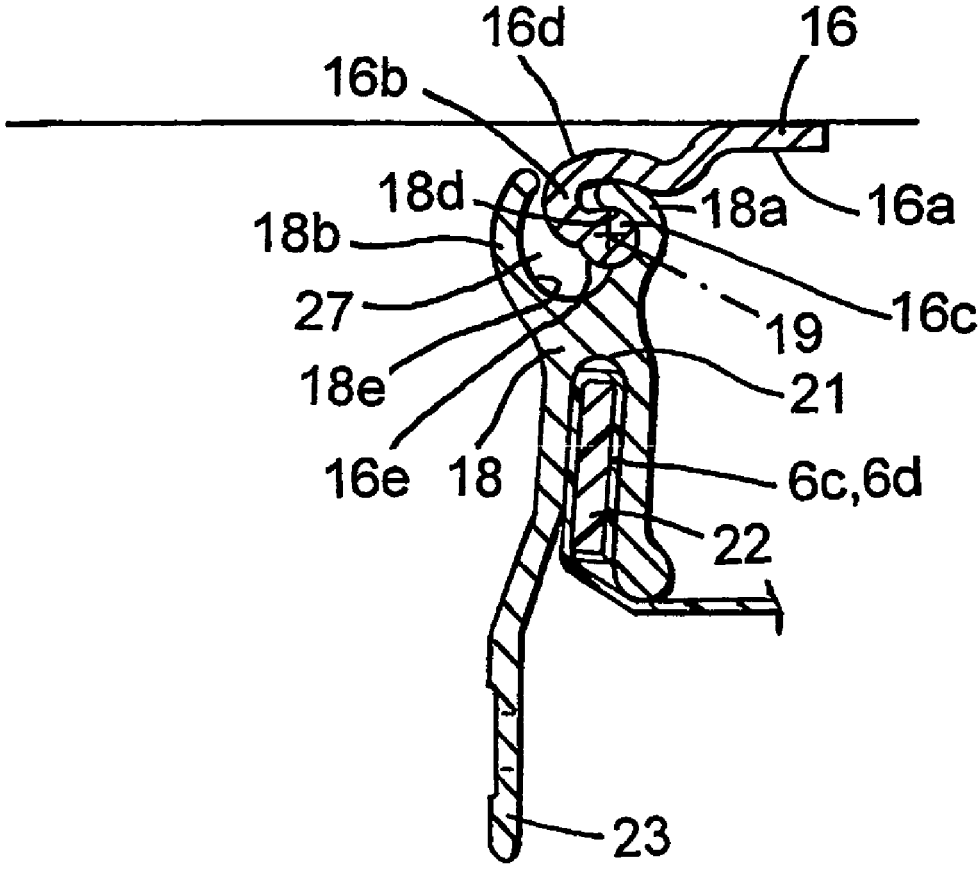
FIG. 6B is a view similar to FIG. 6A, showing the movable member in a passive position.

To remove the poster 6, the covering frame 3 is removed so as to expose the edges of the poster, the screws 24 are removed, and each movable member 18 is pivoted forward through about 90° (or more) from the active position shown in FIG. 6A to the passive position shown in FIG. 6B, in which tension in the poster is released sufficiently to allow the edge portions 6*c*,6*d* to be removed from the recesses 21. The right-hand edge portion 6*b* is then removed from the recess 21 of the right-hand holding device 7*b*, and finally the bead 14 is slid to the left out of the upper holding device 7*a*.

In each of the lower and left lateral holding devices 7*c*,7*d* the fixed bearing member 16 has a fixed end portion 16*a*, an intermediate portion 16*b*, and a free end portion 16*c*. The intermediate portion 16*b* has a convex bearing surface 16*d*, part of which is cylindrical. The free end portion 16*c* has a cylindrical external bearing surface 16*e*, which is co-axial with the cylindrical part of the convex bearing surface 16*d*. The movable member 18 has longitudinal wings 18*a* and 18*b* which define between them an open cavity 27 to receive the free end portion 16*c* and the intermediate portion 16*b*. The wing 18*a* has a concave cylindrical bearing surface 18*d* which matches the cylindrical external bearing surface 16*e*. The wing 18*a* is received in a space 28 between the free end portion 16*c* and the intermediate portion 16*b* when the movable member is in its passive position (FIG. 6B). The wing 18*b* has a concave surface 18*e* which fits against the convex bearing surface 16*b* when the movable member 18 is in its active position (FIG. 6A). The wings 18*a*,18*b* cooperate with the free end portion 16*c* and the intermediate portion 16*b* so as to prevent separation of the movable member 18 from the fixed member 16 in any direction transverse to the pivot axis 19.

Various modifications may be made within the scope of the invention. For example, the right-hand lateral holding device 7*b* could be a mirror image of the left-hand lateral holding device 7*b*.

The undercut slot 12 in the upper holding device 7*a* allows the user to support the poster initially at the top while the lateral position of the poster is adjusted.

The bearing surfaces 16*d*, 16*e* and 18*d*, 18*e* cooperate to ensure that no excessive local stress is applied to the holding devices 7*c*, 7*d* by the taut poster.

The invention claimed is:

1. Display apparatus comprising at least one pair of elongate holding devices extending along opposite sides of an imaginary rectangle, the holding devices having respective longitudinal recesses which hold respective edge portions of a poster, at least one holding device of the pair comprising a fixed bearing member and a movable member which contains the recess and which is pivotable about a pivot axis relative to the fixed bearing member from (a) an active position, in which the recess is open in a direction away from the opposite holding device so that the poster turns back on itself near the edge portion, the poster being under tension between the pair of holding devices, to (b) a passive position, in which tension in the poster is released sufficiently to allow the edge portion to be removed from the recess of the said one holding device; in which the fixed bearing member has a fixed end portion, an intermediate portion, and a free end portion, the intermediate portion has a convex bearing surface, part of which is partially cylindrical, the free end portion has a cylindrical external bearing surface coaxial with the partially cylindrical part of the convex bearing surface of the intermediate portion but of smaller diameter, the movable member has first and second longitudinal wings which define between them an open cavity to receive the free end portion and intermediate portion of the fixed bearing member, the first wing has in the cavity a concave partially cylindrical bearing surface which matches the cylindrical external bearing surface of the free end portion, the first wing is received in a space between the free end portion and the intermediate portion of the fixed bearing member when the movable member is in its passive position, and the second wing has in the cavity a concave surface which fits against the convex bearing surface of the intermediate portion when the movable member is in its active position.

2. Display apparatus comprising at least one pair of elongate holding devices extending along opposite sides of an imaginary rectangle, the holding devices having respective longitudinal recesses for holding respective edge portions of a poster, at least one holding device of the pair comprising a fixed bearing member and a movable member which contains the recess and which is pivotable about a pivot axis relative to the fixed bearing member from (a) a passive position, in which the edge portion of a poster can be inserted into the recess while the poster is held by the opposite holding device, to (b) an active position, in which the recess is open in a direction away from the opposite holding device so that the poster turns back on itself near the edge portion, motion from the passive position to the active position applying tension to the poster; wherein in which the fixed bearing member has a fixed end portion, an intermediate portion, and a free end portion, the intermediate portion has a convex bearing surface, part of which is partially cylindrical, the free end portion has a cylindrical external bearing surface coaxial with the partially cylindrical part of the convex bearing surface of the intermediate portion but of smaller diameter, the movable member has first and second longitudinal wings which define between them an open cavity to receive the free end portion and intermediate portion of the fixed bearing member, the first wing has in the cavity a concave partially cylindrical bearing surface which matches the cylindrical external bearing surface of the free end portion, the first wing is received in a space between the free end portion and the intermediate portion of the fixed bearing member when the movable member is in its passive position, and the second wing has in the cavity a concave surface which fits against the convex bearing surface of the intermediate portion when the movable member is in its active position.

3. Display apparatus as claimed in claim 1 or 2, in which the movable member is connected to the fixed bearing member so that the movable member cannot be removed from the fixed member in any direction transverse to the pivot axis.

4. Display apparatus as claimed in claim 3, in which the wings cooperate with the free end portion and the intermediate portion of the fixed bearing member so as to prevent separation of the movable member from the fixed bearing member in any direction transverse to the pivot axis.

5. Display apparatus as claimed in 1 or 2, in which the said one pair of holding devices are a fixed upper holding device and a lower holding device which constitutes the said one holding device, the recess of the upper holding device being in the form of an undercut slot in an underside of the upper holding device, for accommodating a longitudinal bead on an upper edge portion of the poster so that the bead can be slid along the recess when a lower edge portion of the poster is free of the lower holding device.

6. Display apparatus as claimed in claims 1 or 2, in which the said one pair of holding devices are lateral holding devices.

7. Display apparatus as claimed in claim 6, in which one lateral holding device constitutes the said one holding device, the other lateral holding device being a fixed holding device having a longitudinal recess which is open in a direction away from the said one holding device.

8. Display apparatus as claimed in claim 6, including an upper holding device having an undercut slot in an uderside thereof, for accommodating a longitudinal bead on an upper edge portion of the poster so that the bead can be slid along the upper holding device when a lower edge portion of the poster is free.

9. Display apparatus as claimed in claim 8, including a lower holding device comprising a fixed bearing member and a movable member pivotable relative to the fixed member.

* * * * *